US011667485B2

(12) United States Patent
Aoki

(10) Patent No.: US 11,667,485 B2
(45) Date of Patent: Jun. 6, 2023

(54) SHEET CONVEYANCE APPARATUS, CONTROL METHOD OF THE SAME, AND STORAGE MEDIUM STORING CONTROL PROGRAM OF THE SAME

(71) Applicant: Horizon Inc., Takashima (JP)

(72) Inventor: Eiji Aoki, Takashima (JP)

(73) Assignee: Horizon Inc., Shiga (JP)

( * ) Notice: Subject to any disclaimer, the term of this patent is extended or adjusted under 35 U.S.C. 154(b) by 1 day.

(21) Appl. No.: 17/468,339

(22) Filed: Sep. 7, 2021

(65) Prior Publication Data

US 2022/0073301 A1 Mar. 10, 2022

(30) Foreign Application Priority Data

Sep. 8, 2020 (JP) ..... JP2020-150839

(51) Int. Cl.

| | |
|---|---|
| ***B65H 7/02*** | (2006.01) |
| ***B65H 11/00*** | (2006.01) |
| ***B65H 29/24*** | (2006.01) |
| ***B65H 29/32*** | (2006.01) |
| ***B65H 39/06*** | (2006.01) |

(52) U.S. Cl.

CPC ..... *B65H 7/02* (2013.01); *B65H 11/005* (2013.01); *B65H 29/242* (2013.01); *B65H 29/32* (2013.01); *B65H 39/06* (2013.01); *B65H 2301/42124* (2013.01); *B65H 2301/42261* (2013.01)

(58) Field of Classification Search

CPC ..... B65G 15/58; B65H 2801/27; B65H 2301/435; B65H 2301/42124; B65H 2301/42261; B65H 43/02; B65H 43/06; B65H 11/002; B65H 11/005; B65H 7/02; B65H 29/242; B65H 29/32; B65H 39/06

USPC ..... 270/52.06, 52.16; 271/194, 196, 197

See application file for complete search history.

(56) References Cited

U.S. PATENT DOCUMENTS

| | | | | |
|---|---|---|---|---|
| 5,088,713 | A | 2/1992 | Hayashi | |
| 5,181,706 | A | 1/1993 | Yamamoto et al. | |
| 5,485,261 | A | 1/1996 | Kuroda et al. | |
| 5,857,137 | A | 1/1999 | Sakata et al. | |
| 6,394,443 | B1 * | 5/2002 | Vedoy | B65H 31/32 271/221 |
| 6,567,644 | B1 | 5/2003 | Yasui | |
| 7,905,076 | B2 * | 3/2011 | Rozenfeld | B43M 3/045 53/473 |

(Continued)

FOREIGN PATENT DOCUMENTS

JP H 03-272931 A 12/1991

OTHER PUBLICATIONS

Extended European Search Report dated Feb. 11, 2022 in corresponding application 21191533.5.

*Primary Examiner* — Leslie A Nicholson, III

(74) *Attorney, Agent, or Firm* — Muncy, Geissler, Olds & Lowe, P.C.

(57) ABSTRACT

A sheet conveyance apparatus includes a control unit (120) that controls driving of a belt drive mechanism (4). The control unit (120) performs control such that the sheet is conveyed from the sheet accumulation area if (a) it is determined that the number of sheets currently accumulated in the sheet accumulation area is two or greater, while the sheet is not conveyed from the sheet accumulation area if (b) it is determined that the number of sheets currently accumulated in the sheet accumulation area is one.

7 Claims, 5 Drawing Sheets

(56) References Cited

U.S. PATENT DOCUMENTS 8,123,208 B2 * 2/2012 Cracknell ..... B42C 1/12
270/32
8,905,393 B2 * 12/2014 Ando ..... B65H 39/10
270/58.01

* cited by examiner

SHEET CONVEYANCE APPARATUS, CONTROL METHOD OF THE SAME, AND STORAGE MEDIUM STORING CONTROL PROGRAM OF THE SAME

CROSS REFERENCE TO RELATED APPLICATIONS

This application is based on Japanese Patent Application No. 2020-150839 filed Sep. 8, 2020, the contents of which are incorporated herein by reference in its entirely.

TECHNICAL FIELD

The present disclosure relates to a sheet conveyance apparatus that conveys sheets discharged from an upstream sheet processing apparatus to a downstream sheet processing apparatus, a control method of the sheet conveyance apparatus, and a storage medium storing a control program of the sheet conveyance apparatus.

BACKGROUND ART

In a binding process, a sheet conveyance apparatus is used so that sheets discharged from an upstream sheet processing apparatus (a printing machine or the like) are conveyed to a downstream sheet processing apparatus (a binding apparatus or the like), which improves productivity. The sheet conveyance apparatus is connected to the upstream sheet processing apparatus and the downstream sheet processing apparatus.

In such a case, the sheet conveyance apparatus supplies sheets such that the upstream sheet processing apparatus and the downstream sheet processing apparatus have a synchronized processing timing.

The processing speed of the upstream sheet processing apparatus and the processing speed of the downstream sheet processing apparatus are not the same in general. For example, when the processing speed of the upstream sheet processing apparatus is higher than the processing speed of the downstream sheet processing apparatus, the sheet conveyance apparatus is required to temporarily accumulate sheets and then convey the accumulated sheets to the downstream so as to synchronize the conveying timing with the processing timing of the downstream sheet processing apparatus.

A conventional sheet conveyance apparatus is disclosed in PTL 1, for example. As illustrated in FIG. 18 of PTL 1, the sheet conveyance apparatus has a conveying belt 3 having a plurality of airflow holes and a suction box 6. The sheet conveyance apparatus temporarily accumulates sheets 1 on the conveying belt 3 in a sheet accumulation area. The sheet conveyance apparatus then produces a negative pressure in the suction box 6 to cause the sheets 1 to be sucked on the conveying belt 3 by the airflow holes, and rotates the conveying belt 3 to convey the sheets 1 one by one.

CITATION LIST

Patent Literature

[PTL 1]
Japanese Patent Application Laid-Open H3-272931

SUMMARY

Technical Problem

In such an apparatus, if all the sheets accumulated in the sheet accumulation area have been conveyed out and there is no sheet on the conveying belt, and then if a next sheet enters the sheet accumulation area, the next sheet may be caught on the conveying belt, and may be fold or jammed (sheet jam).

The object to be achieved by the present disclosure is to provide a sheet conveyance apparatus and a control method thereof that enable a sheet to enter a sheet accumulation area without being caught on a conveying belt and to provide a control program for the sheet conveyance apparatus.

Solution to Problem

The sheet conveyance apparatus according to the first aspect of the present disclosure is a sheet conveyance apparatus that conveys a sheet fed out of an upstream sheet processing apparatus to a downstream sheet processing apparatus and includes: a conveying unit that conveys the sheet; a conveying unit drive mechanism that drives the conveying unit; a sheet accumulation area in which the sheet fed out of the upstream sheet processing apparatus is accumulated on the conveying unit; and a control unit that controls conveyance of the sheet performed by the conveying unit.

The control unit includes a counter unit that counts the number of sheets accumulated in the sheet accumulation area, and when a conveyance instruction signal for conveying the sheet from the sheet accumulation area is received and the number of the sheets currently accumulated in the sheet accumulation area is counted to be one by the counter unit, the control unit stops conveyance of the one sheet without conveying the one sheet from the sheet accumulation area until a next sheet is guided onto the one sheet.

In the sheet conveyance apparatus described above, the control unit may include a first determination unit that may determine, based on a count of the sheets by the counter unit, whether the number of the sheets currently accumulated in the sheet accumulation area is two or greater, or one. When it is determined by the first determination unit that the number of the sheets currently accumulated in the sheet accumulation area is two or greater, the control unit may convey the sheet from the sheet accumulation area.

In the sheet conveyance apparatus described above, the control unit may include a second determination unit that may determine whether or not the sheet currently accumulated in the sheet accumulation area is a final sheet to be processed. When it is determined by the second determination unit that the sheet currently accumulated in the sheet accumulation area is the final sheet to be processed, the control unit may perform control to convey the sheet from the sheet accumulation area.

In the sheet conveyance apparatus described above, in response to receiving information on the number of the sheets to be processed from the upstream sheet processing apparatus, the second determination unit may determine, based on the count of the sheets by the counter unit, whether or not the sheet accumulated in the sheet accumulation area is the final sheet to be processed.

In the sheet conveyance apparatus described above, an airflow hole may be formed in the conveying unit, and the sheet conveyance apparatus may include a suction switch mechanism configured to switch whether or not to suck the sheet on the conveying unit through the airflow hole.

The control method of a sheet conveyance apparatus according to the second aspect of the present disclosure is a control method of a sheet conveyance apparatus that conveys a sheet fed out of an upstream sheet processing apparatus to a downstream sheet processing apparatus, the sheet conveyance apparatus includes: a conveying unit that conveys the sheet, a conveying unit drive mechanism that drives the conveying unit, and a sheet accumulation area in which the sheet fed out of the upstream sheet processing apparatus is accumulated on the conveying unit, and the control method includes: when a conveyance instruction signal for conveying the sheet from the sheet accumulation area is received and the number of sheets currently accumulated in the sheet accumulation area is counted to be one, stopping conveyance of the one sheet without conveying the one sheet from the sheet accumulation area until a next sheet is guided onto the one sheet.

The third aspect of the present disclosure is a non-transitory computer readable storage medium storing a control program of the sheet conveyance apparatus that causes a computer to function as the sheet conveyance apparatus described above.

The sheet conveyance apparatus according to the present disclosure enables a sheet to enter the sheet accumulation area without being caught on the conveying unit.

DESCRIPTION OF EMBODIMENTS

Embodiments of a sheet conveyance apparatus according to the present disclosure will be described below with reference to the drawings.

[Configuration]

The configuration of a sheet conveyance apparatus 100 will be described with reference to FIG. 1 to FIG. 3.

Figure 1:
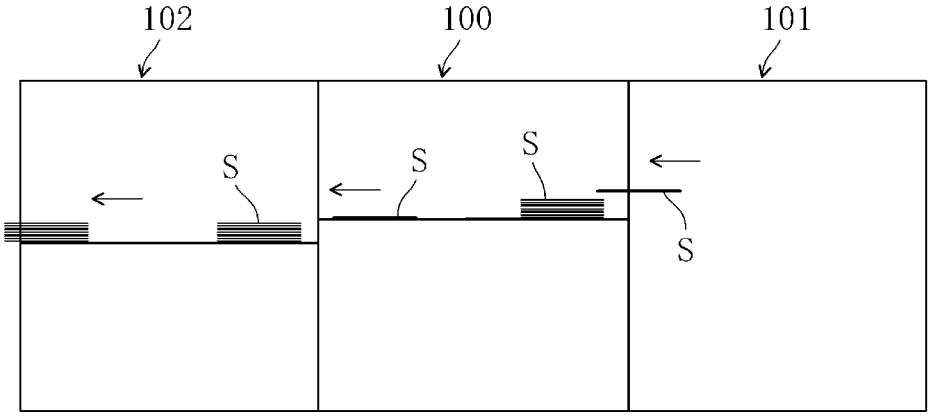
FIG. 1 is a side view illustrating a sheet conveyance apparatus and a sheet processing apparatus according to one embodiment of the present disclosure.

As illustrated in FIG. 1, the sheet conveyance apparatus 100 is connected to an upstream sheet processing apparatus (a printing machine or the like) 101 and a downstream sheet processing apparatus (a binding apparatus or the like) 102. The sheet conveyance apparatus 100 conveys sheets S, which have been discharged from the upstream sheet processing apparatus 101, to the downstream sheet processing apparatus 102 such that the upstream sheet processing apparatus 101 and the downstream sheet processing apparatus 102 have a synchronized processing timing.

Figure 2A:
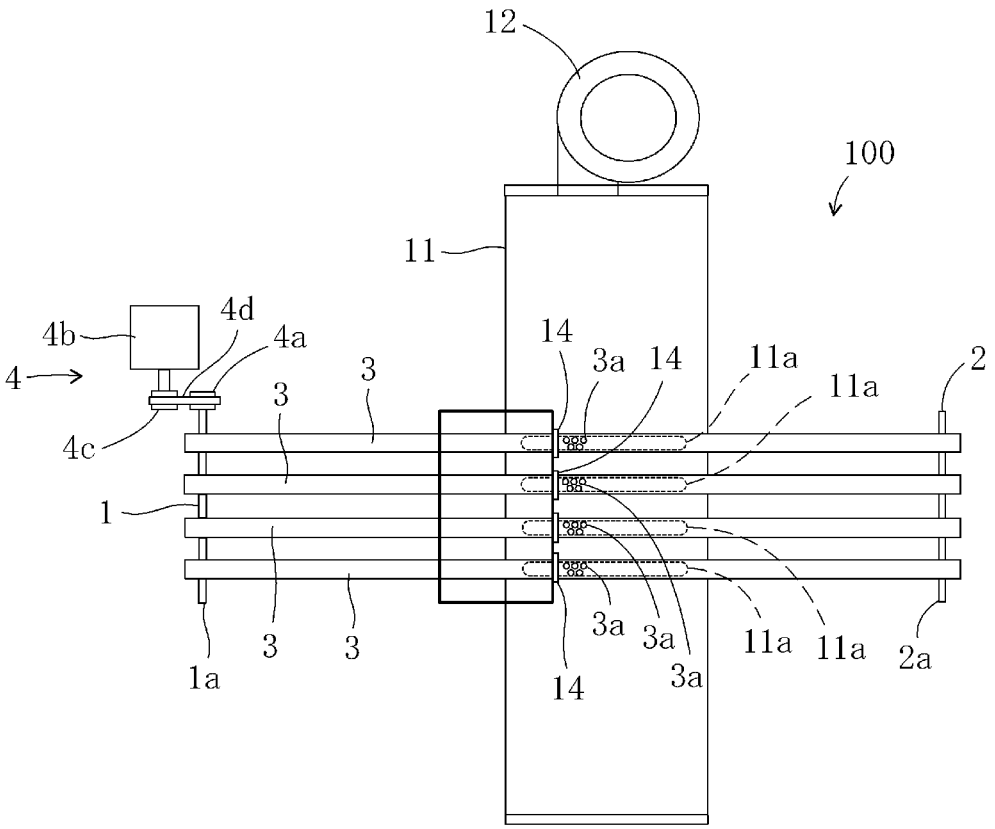
FIG. 2A is a plan view of the sheet conveyance apparatus according to one embodiment of the present disclosure.

As illustrated in FIG. 2, the sheet conveyance apparatus 100 has a drive roller 1 and an idle roller 2 extending parallel to each other and horizontally, four endless conveying belts (a conveying unit) 3 extended between the drive roller 1 and the idle roller 2, and a belt drive mechanism 4 that rotates the drive roller 1.

The drive roller 1 has a horizontal rotary shaft 1*a* and four first pulleys 1*b* arranged spaced apart from each other in the axial direction of the rotary shaft 1*a*. The first pulleys 1*b* are integrally attached to the rotary shaft 1*a* in a rotatable manner.

The idle roller 2 has a shaft 2*a* parallel to the rotary shaft 1*a* of the drive roller 1 and four second pulleys 2*b* rotatable about the shaft 2*a*. The second pulleys 2*b* are each arranged facing the four first pulleys 1*b*.

Each conveying belt 3 is extended between the first pulley 1*b* of the drive roller 1 and the second pulley 2*b* of the idle roller 2. Each conveying belt 3 has a plurality of airflow holes 3*a* at predetermined intervals over the entire length.

The belt drive mechanism 4 has a pulley 4*a* fixed to one end of the rotary shaft 1*a* of the drive roller 1, a motor 4*b* having a drive shaft parallel to the drive roller 1, a pulley 4*c* fixed to the drive shaft of the motor 4*b*, and an endless belt 4*d* extended between the pulley 4*a* and the pulley 4*c*.

In the sheet conveyance apparatus 100, the four conveying belts 3 rotate at a constant speed in response to rotation of the drive roller 1 driven by the motor 4*b*, and the sheets S placed on a conveying face 3*b* of the four conveying belts 3 are conveyed from the idle roller 2 (upstream) toward the drive roller 1 (downstream). Thus, the conveying belt 3 is formed of a material having a large friction coefficient (for example, a natural resin, a synthetic resin) in order to prevent sliding of the sheet S.

The sheet conveyance apparatus 100 has a suction switch mechanism 7 (FIG. 3) configured to switch whether or not to suck the sheet S on the conveying belts 3 via the airflow holes 3*a* of the conveying belts 3. The suction switch mechanism 7 has a suction box 11 arranged between an upper section 3*c* and a lower section 3*d* of the four conveying belts 3 and a suction fan (an intake source) 12 directly connected to the suction box 11. The suction fan (intake source) 12 is configured to generate a negative pressure in the suction box 11.

The suction box 11 has four intake holes 11*a* in the upper face. Each intake hole 11*a* is arranged facing the upper section 3*c* of each conveying belt 3. The suction box 11 further has a shutter 11*b* that opens and closes the intake holes 11*a*.

The suction switch mechanism 7 has a shutter drive mechanism that drives the shutter 11*b*. For example, the shutter drive mechanism has a lift mechanism (not illustrated) attached to the shutter 11*b* and a motor (not illustrated) attached to the lift mechanism. During the operation of the sheet conveyance apparatus 100, while a suction fan 12 is continuously operated, the shutter 11*b* is moved vertically by the lift mechanism, and the shutter 11*b* opens and closes at predetermined timings to switch suction through the intake holes 11*a*.

Figure 2B:
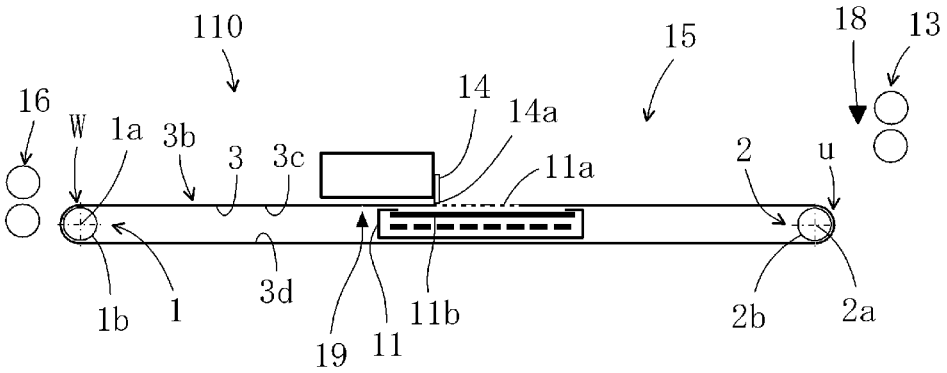
FIG. 2B is a side view of the sheet conveyance apparatus according to one embodiment of the present disclosure.

As illustrated in FIG. 2B, the sheet conveyance apparatus 100 has a feed-in roller 13 on the upstream. The feed-in roller 13 is provided above the upstream end u of the conveying face 3*b* of the conveying belts 3 and takes in and conveys the sheet S onto the conveying face 3*b*. The sheet conveyance apparatus 100 further has a stopper plate 14 extending upward from the conveying face 3*b*.

In this embodiment, the stopper plate 14 is divided into four portions in the width direction orthogonal to the longitudinal direction of the conveying belt 3, and the portions of the stopper plate 14 correspond to respective conveying belts 3. Note that the stopper plate 14 may be a single plate extending across the whole conveying face 3*b* of the four conveying belts 3.

A lower end 14*a* of the stopper plate 14 faces the suction box 11 and is arranged spaced apart from the conveying face 3*b* by a predetermined spacing.

The sheet conveyance apparatus 100 has a sheet accumulation area 15 that is a region from the stopper plate 14 above the conveying face 3*b* to the upstream end u of the conveying face 3*b*.

The sheet conveyance apparatus 100 has a feed-out roller 16 on the downstream. The feed-out roller 16 receives the sheet S from the downstream end w of the conveying face 3*b* and discharges the received sheet S to the outside of the sheet conveyance apparatus 100.

During the operation of the sheet conveyance apparatus 100, the sheets S are taken in from the upstream sheet processing apparatus 101 by the feed-in roller 13. The front end of the sheet S collides with the stopper plate 14, and the sheet S is sequentially accumulated in the sheet accumulation area 15. The lowermost sheet S out of the accumulated sheets S is then sequentially adsorbed on the conveying face 3*b* of the conveying belts 3 by the suction box 11 and separated from the remaining sheets S. The lowermost sheet S is then conveyed through the gap between the conveying face 3*b* and the stopper plate 14 to the downstream end w of the conveying face 3*b* by the conveying belts 3 and supplied to the downstream sheet processing apparatus 102 by the feed-out roller 16.

In such a way, even when the processing speed of the upstream sheet processing apparatus 101 and the processing speed of the downstream sheet processing apparatus 102 are different, the sheet conveyance apparatus 100 can temporarily accumulate the sheets S sequentially discharged from the upstream sheet processing apparatus 101 in the sheet accumulation area 15. Then, the sheet conveyance apparatus 100 can supply the lowermost sheet S out of the accumulated sheets S from the sheet accumulation area 15 to the downstream sheet processing apparatus 102 one by one at timings synchronized with the processing speed of the downstream sheet processing apparatus 102. Therefore, the sheet conveyance apparatus 100 can smoothly hand over the sheet S from the upstream processing apparatus 101 to the downstream sheet processing apparatus 102.

Figure 3:
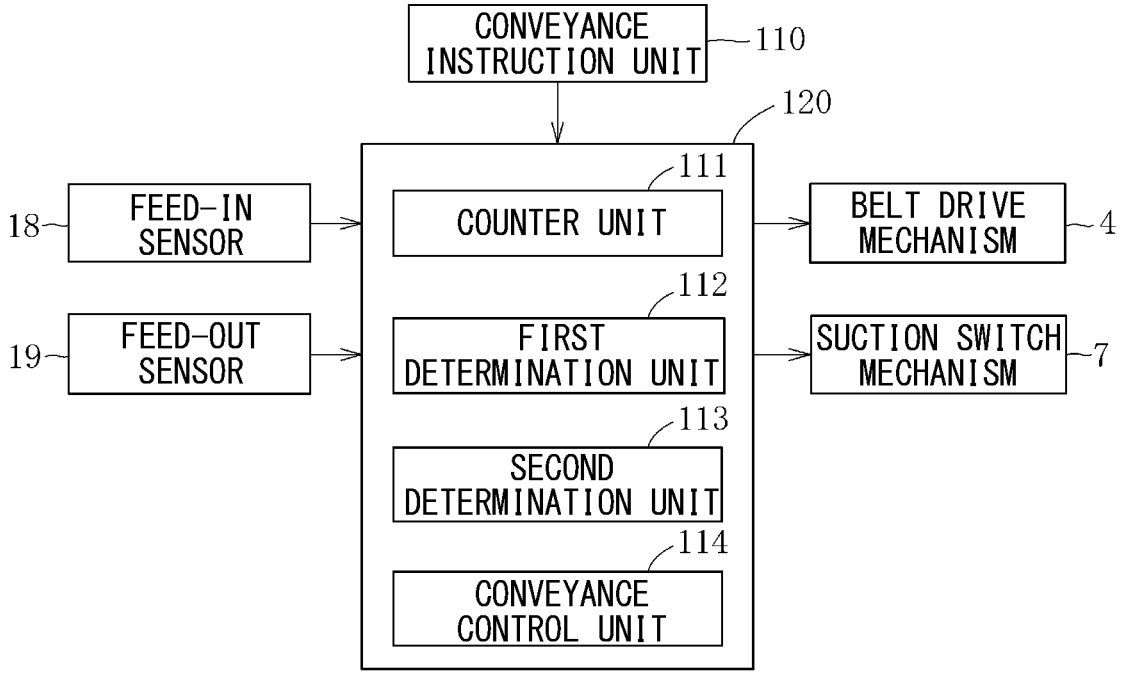
FIG. 3 is a block diagram illustrating a configuration of a part of the sheet conveyance apparatus according to one embodiment of the present disclosure.

As illustrated in FIG. 2 and FIG. 3, the sheet conveyance apparatus 100 has a feed-in sensor 18 provided downstream of the feed-in roller 13. The feed-in sensor 18 is configured to detect the sheet S fed into the sheet accumulation area 15. The sheet conveyance apparatus 100 further has a feed-out sensor 19 provided downstream of the stopper plate 14. The feed-out sensor 19 is configured to detect the sheet S fed out of the sheet accumulation area 15.

As illustrated in FIG. 3, the sheet conveyance apparatus 100 has a control unit 120 connected to the feed-in sensor 18, the feed-out sensor 19, the belt drive mechanism 4, and the suction switch mechanism 7. The control unit 120 is formed of, for example, a central processing unit (CPU), a random access memory (RAM), a read only memory (ROM), a computer readable storage medium, and the like. Further, a series of processes to implement respective functions is stored in a storage medium or the like in a form of a program, as an example. The CPU reads such a program into the RAM or the like and executes a process of edition and operation of information, so that various functions are implemented. Note that a program may be installed in advance in a ROM or other storage mediums, a program may be provided in a state of being stored in a computer readable storage medium, or a program may be delivered via a wired or wireless communication unit. The computer readable storage medium is a magnetic disk, a magneto-optical disk, a CD-ROM, a DVD-ROM, a semiconductor memory, or the like.

The control unit 120 is further connected to a conveyance instruction unit 110. The conveyance instruction unit 110 is programed in a control unit (not illustrated) of the sheet processing apparatuses 101 and 102, for example. The conveyance instruction unit 110 transmits, to the control unit 120 of the sheet conveyance apparatus 100, an accumulation instruction signal AS for accumulating the sheet S without conveying the sheet S from the sheet accumulation area 15 and a conveyance instruction signal CS for conveying the sheet S from the sheet accumulation area 15.

The control unit 120 includes a counter unit 111, a first determination unit 112, a second determination unit 113, and a conveyance control unit 114. The counter unit 111, the first determination unit 112, the second determination unit 113, and the conveyance control unit 114 are controlled by a control program stored in the control unit 120.

The counter unit 111 is configured to count the sheets S fed into the sheet accumulation area 15 by using the feed-in sensor 18, and count the sheets S fed out of the sheet accumulation area 15 by the feed-out sensor 19. Then, based on the difference between the counts, the counter unit 111 is configured to count the number of sheets S currently accumulated in the sheet accumulation area 15.

The first determination unit 112 is configured to determine, based on the count of the sheets S by the counter unit 111, whether the number of sheets S currently accumulated in the sheet accumulation area 15 is two or greater, or one.

The second determination unit 113 determines, in response to receiving a signal indicating the end of process from the conveyance instruction unit 110, that the sheet S accumulated in the sheet accumulation area 15 is the final sheet FS to be processed. Further, in response to receiving information on the number of sheets S to be processed from the conveyance instruction unit 110, the second determination unit 113 determines, based on the count of sheets S received from the counter unit 111, whether or not the sheet S accumulated in the sheet accumulation area 15 is the final sheet FS to be processed. For example, when the number of sheets S to be processed is 10, the tenth sheet S conveyed from the sheet accumulation area 15 is determined to be the final sheet FS.

The conveyance control unit 114 is configured to control driving of the belt drive mechanism 4 and the suction switch mechanism 7. When conveying the sheet S from the sheet accumulation area 15, the conveyance control unit 114 controls the shutter 11*b* to open to adsorb the sheet S on the conveying face 3*b* of the conveying belts 3 and controls the conveying belts 3 to rotate. On the other hand, when accumulating the sheet S in the sheet accumulation area 15, the conveyance control unit 114 controls the shutter 11*b* to close and controls the conveying belts 3 not to rotate.

[Operation]

The operation of the sheet conveyance apparatus 100 will be described with reference to FIG. 4 and FIG. 5.

The sheet conveyance apparatus 100 receives the accumulation instruction AS and the conveyance instruction CS from the conveyance instruction unit 110 (step S1). In response to receiving the accumulation instruction AS from the conveyance instruction unit 110, the sheet conveyance apparatus 100 accumulates the sheet S from the feed-in roller 13 in the sheet accumulation area 15 and does not convey the sheet S from the sheet accumulation area 15 (step S2).

In response to receiving the conveyance instruction CS from the conveyance instruction unit 110, the sheet conveyance apparatus 100 determines by the first determination unit 112 whether or not the number of sheets S currently accumulated in the sheet accumulation area 15 is two or greater, or one (step S3).

Figure 4A:
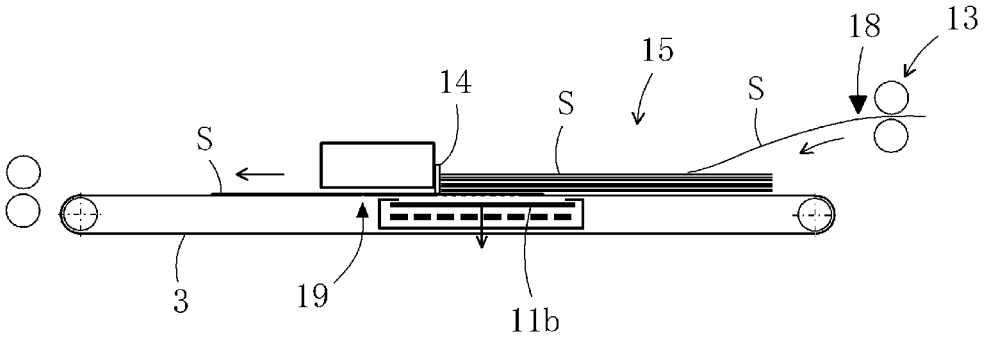
FIG. 4A to FIG. 4C are side views illustrating the operation of the sheet conveyance apparatus according to one embodiment of the present disclosure.
Figure 5:
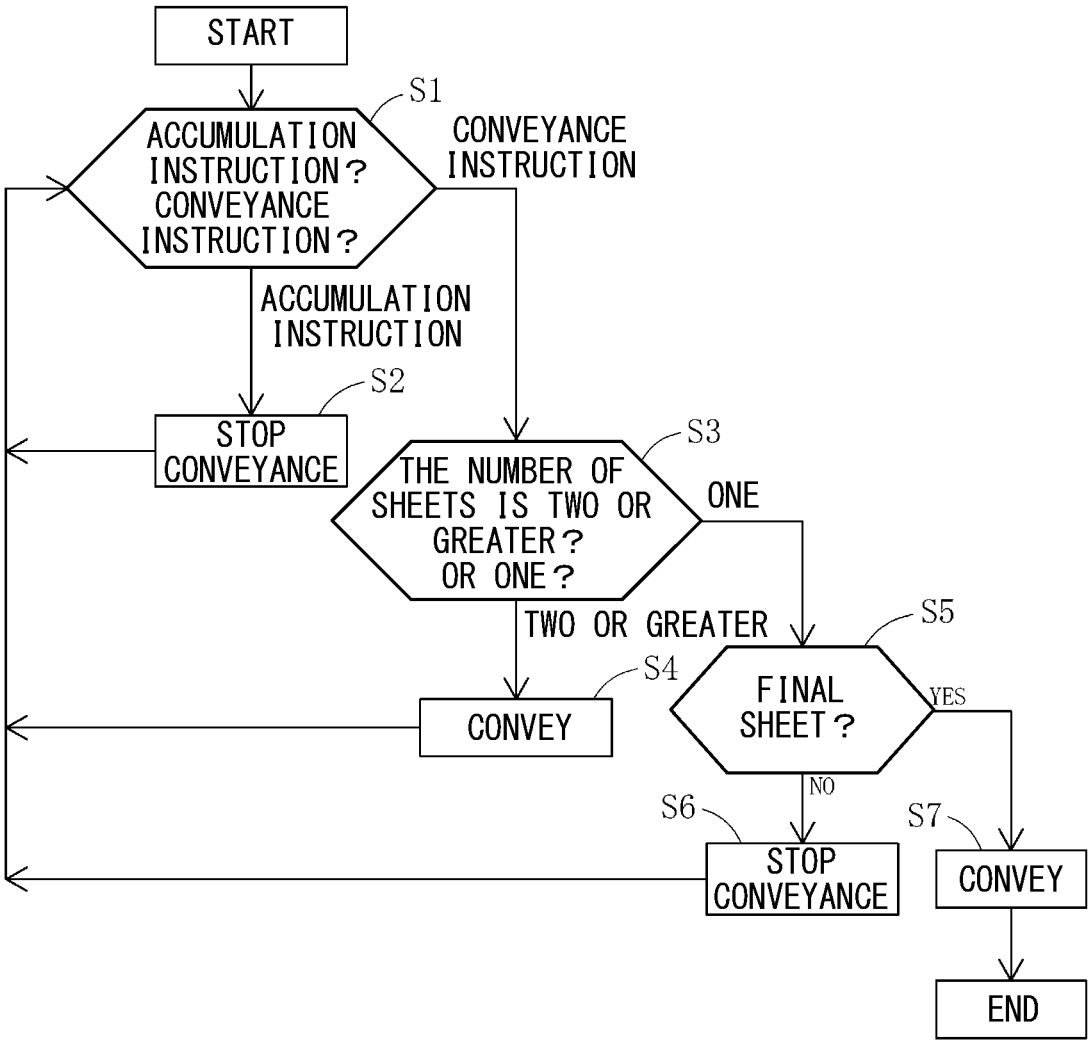
FIG. 5 is a flowchart diagram illustrating the operation of the sheet conveyance apparatus according to one embodiment of the present disclosure.

If the number of sheets S currently accumulated in the sheet accumulation area 15 is two or greater, the sheet conveyance apparatus 100 conveys the sheet S from the sheet accumulation area 15 as illustrated in FIG. 4A (step S4).

If the number of sheets S currently accumulated in the sheet accumulation area 15 is one, the sheet conveyance apparatus 100 determines by the second determination unit 113 whether or not the sheet S accumulated in the sheet accumulation area 15 is the final sheet FS to be processed (step S5).

If the one sheet S accumulated in the sheet accumulation area 15 is not the final sheet FS to be processed even when the conveyance instruction CS is received from the conveyance instruction unit 110, the sheet conveyance apparatus 100 leaves the one sheet S in the sheet accumulation area 15 without conveying the sheet S from the sheet accumulation area 15 (step S6).

Figure 4B:
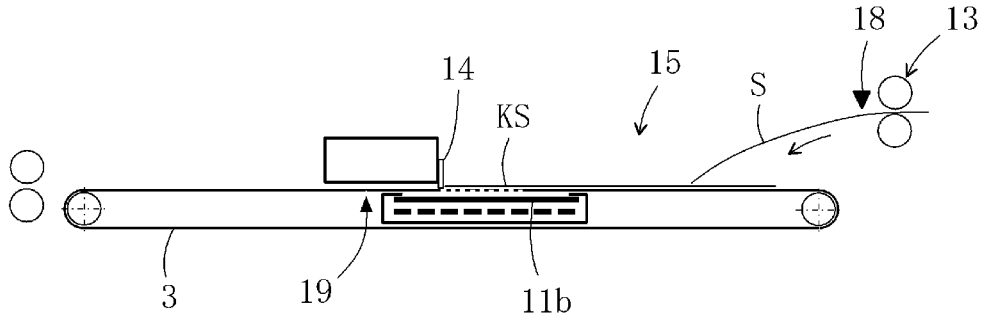

As illustrated in FIG. 4B, the one sheet S left in the sheet accumulation area 15 is used as a skid sheet KS, the sheet S fed in from the feed-in roller 13 slides on the one left sheet S (a skid sheet KS) and is accumulated in the sheet accumulation area 15. Since the friction coefficient of the sheet S (skid sheet KS) is not higher than the conveying belts 3, the next sheet S can smoothly enter the sheet accumulation area 15 without being caught by the conveying belts 3.

Figure 4C:
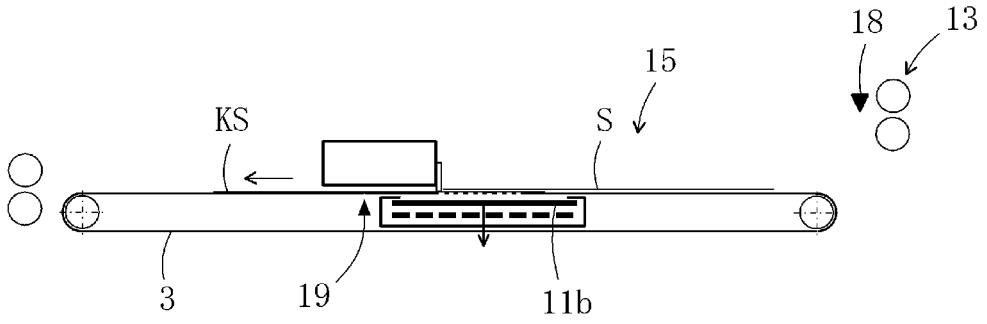

After two sheets S are accumulated in the sheet accumulation area 15, the first determination unit determines that the number of sheets S currently accumulated in the sheet accumulation area 15 is two or greater (step S3). Then, as illustrated in FIG. 4C, the sheet conveyance apparatus 100 conveys the sheet S used as the skid sheet KS from the sheet accumulation area 15 (step S4).

If it is determined by the first determination unit 112 that the number of sheets S currently accumulated in the sheet accumulation area 15 is one (step S3) and it is determined by the second determination unit 113 that the one sheet S accumulated in the sheet accumulation area 15 is the final sheet FS to be processed, the sheet conveyance apparatus 100 conveys the sheet S from the sheet accumulation area 15 (step S7). This is because no next sheet S is fed into the sheet accumulation area 15 and it is thus not necessary to leave the one sheet S in the sheet accumulation area 15 as the skid sheet KS.

The advantageous effects of the present embodiment will be described.

If the sheet S accumulated in the sheet accumulation area 15 is not the final sheet FS to be processed even when the conveyance instruction CS is received from the conveyance instruction unit 110, the sheet conveyance apparatus 100 leaves one sheet S in the sheet accumulation area 15 without conveying the sheet S from the sheet accumulation area 15.

The one sheet S left in the sheet accumulation area 15 is used as the skid sheet KS, and the next sheet S fed in from the feed-in roller 13 slides on the one left sheet S (skid sheet KS) and is accumulated in the sheet accumulation area 15. As a result, the sheet S can enter the sheet accumulation area 15 without being caught by the conveying belts 3.

Although the preferred embodiment of the present disclosure has been described above, the configuration of the present disclosure is not limited to this embodiment.

For example, the suction switch mechanism 7 may have a path connected between the suction box 11 and the suction fan 12, and a closure mechanism that opens and closes the path. The path may be opened or closed by the closure mechanism to switch whether or not to suck the sheet S on the conveying belts 3 through the airflow holes 3*a* in the conveying belts 3. Further, with respect to the suction switch mechanism 7, no suction box 11 may be provided, and the suction fan 12 and the airflow holes 3*a* of the endless conveying belts 3 may be directly connected via a path.

Further, although the present embodiment has been described by using the conveying belts 3, the present disclosure is not limited thereto, and any conveying unit such as a conveying roller, for example, may be employed.

REFERENCE SIGNS LIST

3 conveying belt (conveying unit)
3*a* airflow hole
3*b* conveying face
3*c* upper section
3*d* lower section
4 belt drive mechanism
11 suction box
11*a* intake hole
11*b* shutter
12 suction fan (intake source)
14 stopper plate
15 sheet accumulation area
7 suction switch mechanism
120 control unit
110 conveyance instruction unit
111 counter unit
112 first determination unit
113 second determination unit
114 conveyance control unit
S sheet
FS final sheet
KS skid sheet

The invention claimed is:

1. A sheet conveyance apparatus that conveys a sheet fed out of an upstream sheet processing apparatus to a downstream sheet processing apparatus, the sheet conveyance apparatus comprising:

a conveying unit configured to convey the sheet;

a conveying unit drive mechanism configured to drive the conveying unit;

a sheet accumulation area in which the sheet fed out of the upstream sheet processing apparatus is accumulated on the conveying unit; and a control unit configured to control conveyance of the sheet performed by the conveying unit, wherein the conveying unit is configured to convey a lowermost sheet of one or more sheets accumulated in the sheet accumulation area one by one, wherein the control unit includes a counter unit configured to count a number of sheets accumulated in the sheet accumulation area, and wherein, when a conveyance instruction signal for conveying the sheet from the sheet accumulation area is received and the number of the sheets currently accumulated in the sheet accumulation area is counted to be one by the counter unit, the control unit stops conveyance of the one sheet without conveying the one sheet from the sheet accumulation area until a next sheet is guided onto the one sheet.

2. The sheet conveyance apparatus according to claim 1, wherein the control unit comprises a sheet number determination unit configured to determine, based on a count of the sheets by the counter unit, whether the number of the sheets currently accumulated in the sheet accumulation area is two or greater, or one, and wherein, when it is determined by the sheet number determination unit that the number of the sheets currently accumulated in the sheet accumulation area is two or greater, the control unit conveys the sheet from the sheet accumulation area.

3. The sheet conveyance apparatus according to claim 1, wherein the control unit comprises a final sheet determination unit that determines whether or not the sheet currently accumulated in the sheet accumulation area is a final sheet to be processed, and wherein, when it is determined by the final sheet determination unit that the sheet currently accumulated in the sheet accumulation area is the final sheet to be processed, the control unit performs control to convey the sheet from the sheet accumulation area.

4. The sheet conveyance apparatus according to claim 3, wherein in response to receiving information on the number of the sheets to be processed from the upstream sheet processing apparatus, the final sheet determination unit determines, based on the count of the sheets by the counter unit, whether or not the sheet accumulated in the sheet accumulation area is the final sheet to be processed.

5. The sheet conveyance apparatus according to claim 1, wherein an airflow hole is formed in the conveying unit, and wherein the sheet conveyance apparatus further comprises a suction switch mechanism configured to switch whether or not to suck the sheet on the conveying unit through the airflow hole.

6. A control method of a sheet conveyance apparatus that conveys a sheet fed out of an upstream sheet processing apparatus to a downstream sheet processing apparatus, wherein the sheet conveyance apparatus comprises:

a conveying unit that conveys the sheet;

a conveying unit drive mechanism that drives the conveying unit; and a sheet accumulation area in which the sheet fed out of the upstream sheet processing apparatus is accumulated on the conveying unit, wherein the conveying unit is configured to convey a lowermost sheet of one or more sheets accumulated in the sheet accumulation area one by one, wherein the control method comprises:

when a conveyance instruction signal for conveying the sheet from the sheet accumulation area is received and the number of sheets currently accumulated in the sheet accumulation area is counted to be one, stopping conveyance of the one sheet without conveying the one sheet from the sheet accumulation area until a next sheet is guided onto the one sheet.

7. A non-transitory computer readable storage medium storing a control program of the sheet conveyance apparatus so as to control the sheet processing apparatus according to claim 1.

* * * * *